US005951308A

United States Patent [19]

Rea

[11] Patent Number: 5,951,308

[45] Date of Patent: Sep. 14, 1999

[54] IGNITION TERMINAL WITH WELDED BARREL BEAM

[75] Inventor: Michael Wayne Rea, Salem, Ohio

[73] Assignee: General Motors Corporation, Detroit, Mich.

[21] Appl. No.: 08/959,906

[22] Filed: Oct. 29, 1997

[51] Int. Cl.[6] ..... H01R 13/44

[52] U.S. Cl. ..... 439/125

[58] Field of Search ..... 439/125, 127, 439/839, 126, 851, 852, 854, 856, 858, 855, 860

[56] References Cited

U.S. PATENT DOCUMENTS

| | | | |
|---|---|---|---|
| 3,573,709 | 4/1971 | Elliot | 339/26 |
| 3,597,723 | 8/1971 | Schmidt et al. | 339/26 |
| 4,009,924 | 3/1977 | Bungo et al. | 439/848 |
| 4,863,391 | 9/1989 | Mochizuki | 439/125 |
| 4,880,389 | 11/1989 | Mochizuki et al. | 439/125 |
| 5,267,869 | 12/1993 | Nadasky et al. | 439/125 |
| 5,334,058 | 8/1994 | Hotea | 439/839 |
| 5,344,328 | 9/1994 | Suggs | 439/127 |
| 5,593,308 | 1/1997 | Kobayashi | 439/125 |
| 5,716,244 | 2/1998 | Engenolf et al. | 439/843 |

*Primary Examiner*—Gary F. Paumen
*Assistant Examiner*—Briggitte R. Hammond
*Attorney, Agent, or Firm*—Patrick M. Griffin

[57] ABSTRACT

A terminal for making an electrical connection to a spark plug. The terminal has a first end for attachment to a wire and a second end having a spark plug terminal barrel. The terminal barrel includes two tabs that are curved to converge on each other forming a seam. The tabs are welded together to prevent the tab from being spread open, particularly under side-load conditions.

15 Claims, 3 Drawing Sheets

IGNITION TERMINAL WITH WELDED BARREL BEAM

TECHNICAL FIELD

This invention relates to ignition terminal systems.

BACKGROUND OF THE INVENTION

Many combustion engines utilize conventional spark plugs for igniting fuel in a piston chamber. FIG. 1 illustrates a spark plug ignition terminal system known to those skilled in the art. A conventional spark plug includes a central electrode 10 a portion of which is covered with a ceramic insulator 12. A first end 14 extends outwardly from the ceramic insulator 12 and is spaced a distance from a ground electrode 16. A second end 18 has a terminal post 20 thereon. The terminal post includes an annular groove 22 formed on an outer surface adjacent a terminal engagement head 24. A threaded metal housing 26 may surround a portion of the ceramic insulator 12 and includes a hex nut feature 28 for tightening the spark plug into a threaded bore of an engine. The prior art ignition terminal includes a first end including crimp wings 30 for crimping onto an ignition wire 32. A second end of the terminal includes a terminal barrel formed by converging tabs 34. The tabs 34 butt up against each other in an unconnected relation. A snap ring 36 is placed around the terminal barrel and includes raised features at opposed ends. As shown in FIG. 2, each raised feature 38 extends through an aperture 40 formed in tab 34 defining the terminal barrel and so that the raised features 38 are received in the annular groove 22 formed in the terminal post 20.

Notwithstanding the use of the snap ring 36, the prior art terminal barrel tabs 34 can spread open under certain circumstances. The barrel tabs 34 can be opened with relatively little force applied to the converging tabs in a direction perpendicular to the spark plug terminal axis (or to the longitudinal axis of the terminal barrel). For example, the barrel tabs are often opened by repeated terminal engagements and removal that applies side-loading. That is, by not engaging or pulling the terminal off the spark plug in a direction parallel to the longitudinal axis of the terminal barrel.

Although terminals having barrels formed from interlocking tabs are known, these terminals still suffer from this side-loading phenomenon. In fact, the use of interlocking tabs makes the side-loading problem worse because once the interlocking tabs are opened by side-loading they are much more difficult to properly put back together.

The present invention provides advantages over and alternatives to the prior art ignition terminal systems.

SUMMARY OF THE INVENTION

The invention includes a terminal for making an electrical connection to a spark plug. The terminal has a first end for attachment to a wire and a second end having a spark plug terminal barrel. The terminal barrel includes two tabs that are curved to converge on each other forming a seam. The tabs are welded together to prevent the tabs from being spread open, particularly under side-load conditions.

In a preferred embodiment, the terminal have apertures formed through the tabs. A snap ring having raised features on an inside face is placed over the terminal barrel with a raised feature received in a respective aperture and designed to engage an annular groove in a spark plug terminal post. Laser spot welds are formed along the edges of the tabs on each side of the snap ring.

These and other objects, features and advantages of the present invention will be apparent from the following brief description of the drawings, detailed description and appended claims and drawings.

DESCRIPTION OF THE PREFERRED EMBODIMENT

Figure 1:
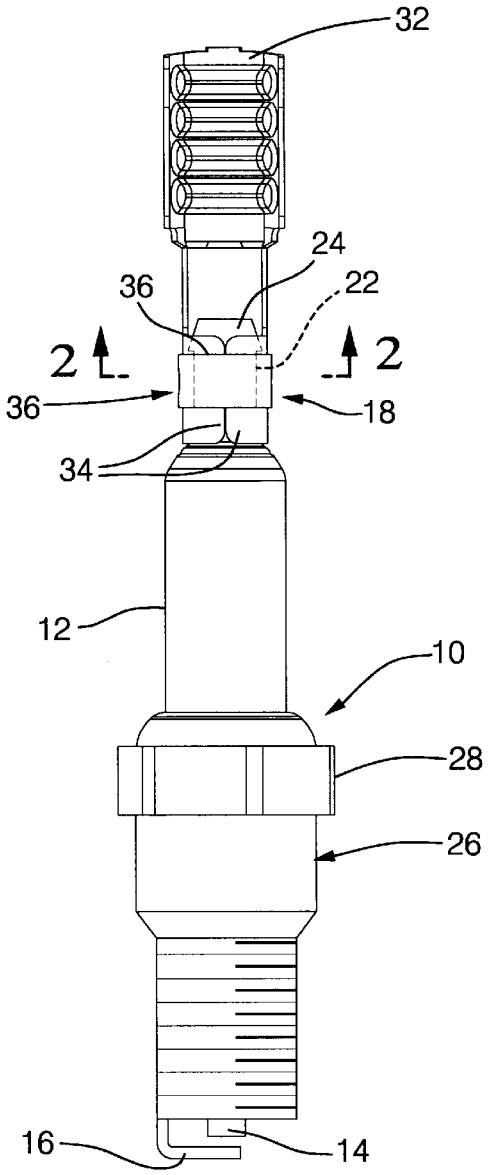
PRIOR ART FIG. 1
FIG. 1 is an illustration of an ignition terminal and spark plug system according to the prior art.
Figure 2:
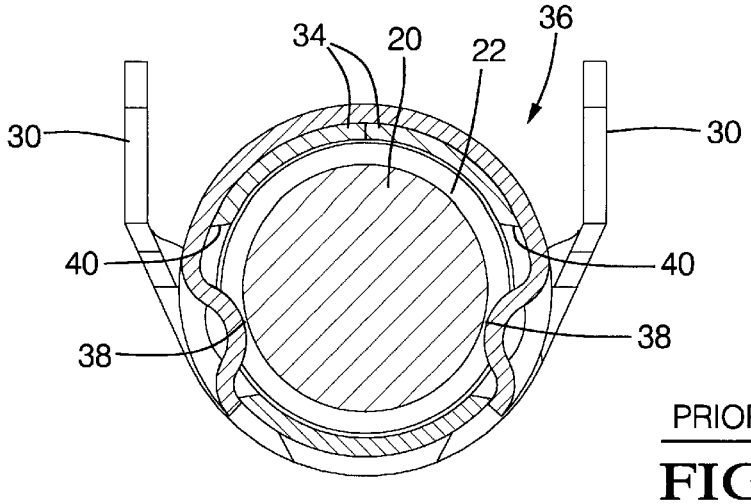
PRIOR ART FIG. 2
FIG. 2 is an enlarged sectional view taken along 2—2 of FIG. 1.
Figure 3:
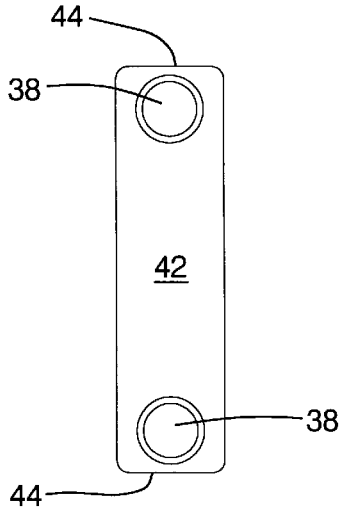
PRIOR ART FIG. 3
FIG. 3 illustrates a blank used to make the snap ring in FIGS. 1–2.
Figure 4:
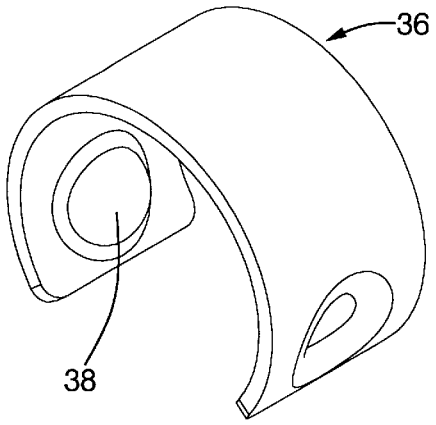
PRIOR ART FIG. 4
FIG. 4 is a perspective view of the snap ring in FIGS. 1–2.

As shown in FIG. 1, a conventional spark plug includes a central electrode 10 a portion of which is covered with a ceramic insulator 12. A first end 14 extends outwardly from the ceramic insulator 12 and is spaced a distance from a ground electrode 16. A second end 18 has a terminal post 20 threaded or cold headed thereon. The terminal post includes an annular groove 22 formed on an outer surface adjacent a terminal engagement head 24. A threaded metal housing 26 may surround a portion of the ceramic insulator 12 and includes a hex nut feature 28 for tightening the spark plug into a threaded bore of an engine. The prior art ignition terminal includes a first end including crimp wings 30 for crimping onto an ignition wire 32. A second end of the terminal includes a terminal barrel 54 formed by converging tabs 34 forming a seam 35. A snap ring 36 is placed around the terminal barrel and includes raised features at opposed ends. As shown in FIG. 2, each raised feature 38 extends through an aperture 40 formed in a tab 34 defining the terminal barrel 54 and so that the raised features 38 are received in the annular groove 22 formed in the terminal post 20. Notwithstanding the snap ring 36, the terminal barrel tabs can be spread open by side-loading as described earlier.

Figure 5:
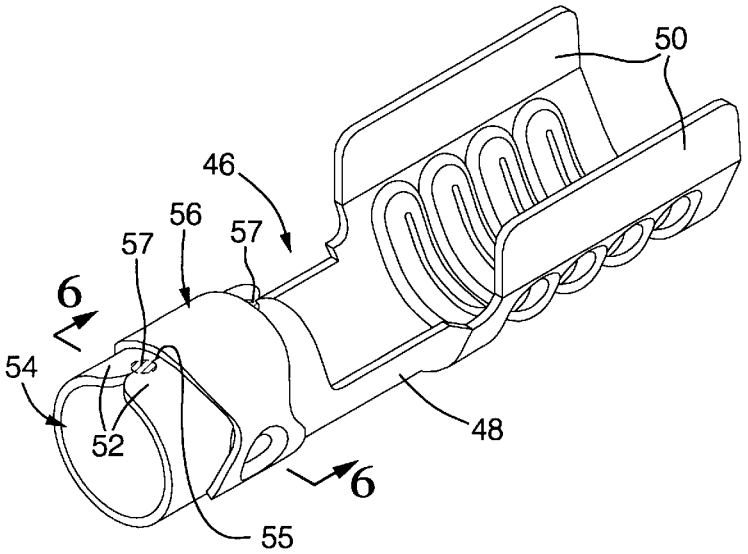
FIG. 5 is a perspective view of an ignition terminal having a welded terminal barrel seam according to the present invention.

FIG. 5 illustrates a single-piece ignition terminal 46 according to the present invention. The ignition terminal 46 is made in a progressive stamping process wherein a single-piece blank is cut from foil stock and formed to provide the single-piece terminal. The terminal includes a central body portion 48 having crimp wings 50 extending outwardly from the body portion at one end for crimping onto an ignition wire or cable. A pair of tabs 52 extend outwardly from the body portion at an opposite end and are curled towards each other to define a terminal barrel 54 to form a seam 55. A snap ring 56 is installed over the terminal barrel 54. The terminal tabs 52 are welded together by spot welds, preferably at locations on each side of the snap ring 56. The weld is preferably formed using a YAG laser welding machine positioned in the progressive stamping process either before or after the snap ring 56 is installed. The weld takes only milliseconds to form and without any significant disruption of the convention stamping and forming process.

Figure 7:
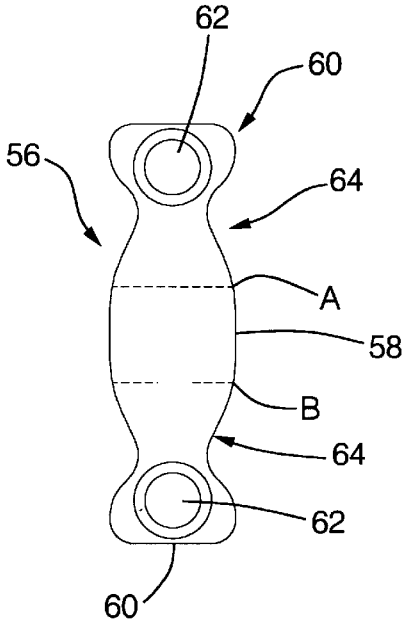
FIG. 7 is a tapered blank used to form a snap ring useful with the present invention.
Figure 8:
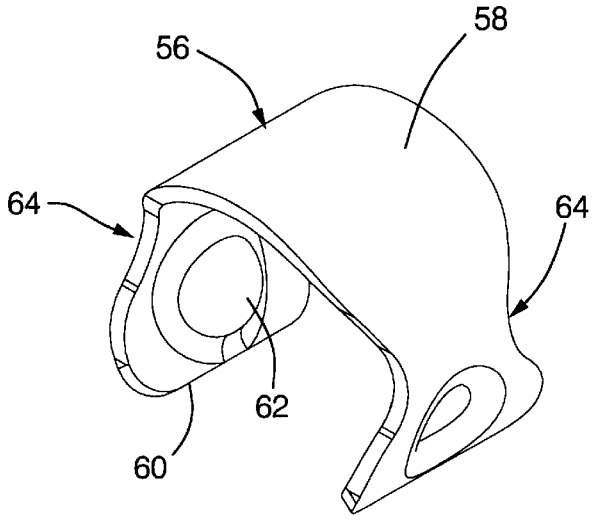
FIG. 8 is the tapered blank of FIG. 7 formed into a snap ring.

As shown in FIG. 7, the snap ring 56 is made from a blank having a middle portion 58 defined generally as the materials between lines A and B and two opposite end portions 60. A raised feature 62 are formed in the blank near a respective end portion 60. The blank includes a tapered portion 64 positioned between the middle portion 58 and the raised feature 62. The amount of material traversing the width of the blank at the tapered portion 64 is less than the amount of material traversing the width of the blank near the middle portion (lines A–B). By way of example, for a blank having a longitudinal length of about 18 mm, the middle portion (A–B) will have a width of about 5 mm, and the tapered portion 64 will have a width of about 3 mm. Contrary to the conventional snap rings, the configuration of the present snap ring allows the raised features 62 to be made with an increased height of 10 percent or greater, (i.e., to about 1.1 mm). As shown in FIG. 8, the blank is formed in a near circular configuration to be received over the terminal barrel 54.

Figure 6:
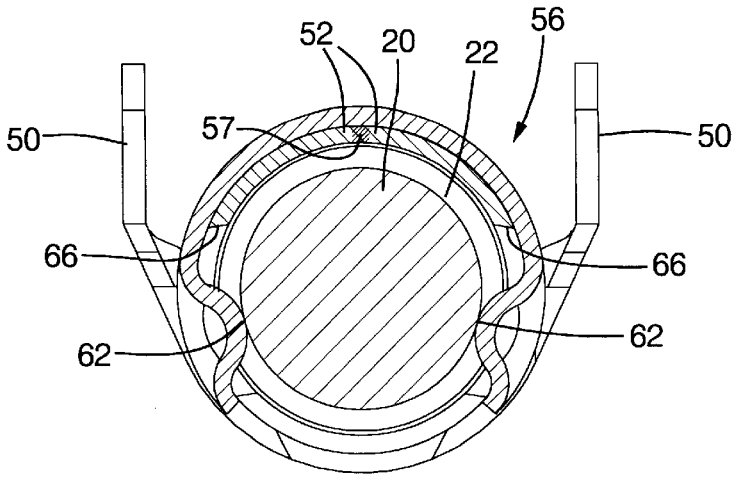
FIG. 6 is an enlarged sectional view taken along line 6—6 of FIG. 5.

FIG. 6 is a sectional view of the present terminal on a conventional spark plug wherein the raised feature 62 extends through apertures 66 formed in the tabs 52 of the terminal and so that the raised feature 62 engages a spark plug terminal at the location of an annular groove 22 formed adjacent a terminal engagement head 24. As such, an interference fit of 0.15 mm is provided between the raised feature 62 and the terminal post at the annular groove 22 so that constant pressure is applied to the terminal post or second end of the central electrode. The terminal is held firmly in position and does not rotate or rattle. Due to the configuration of the snap ring with enlarged raised features, it may be installed over the terminal barrel 54 without deforming the snap ring so as to cause a permanent set.

Figure 9:
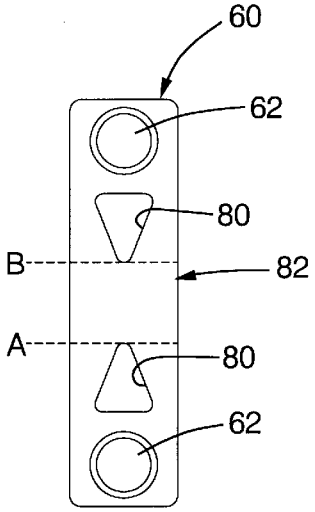
FIG. 9 is another embodiment of the present invention showing a blank having tapered portions used to make a snap ring according to the present invention.

In another embodiment of the present invention illustrated in FIG. 9, a tapered snap ring may be provided from a rectangular-shaped blank having raised features 62 formed respectively at associated ends 60. Material may be punched out or removed from the blank to provide an aperture 80 at a location near the raised feature 62 so that the total material traversing the blank at the tapered portion or punched out portion 82 is less than the material traversing the width of the blank at the middle portion 58 defined by lines A–B.

Due to the increased retention property of the tapered snap ring 56 described above, even greater side-loading forces may be applied by an operator in engaging or disengaging the terminal to a spark plug. This makes the need for a barrel that has tabs permanently fixed together by welding the like all that more desirable.

I claim:

1. An ignition terminal system for use on a spark plug having a terminal post having a head portion and an annular groove formed in the terminal post immediately below the head portion, comprising: an ignition terminal having a body portion and crimp wings extending outwardly from the body portion near one end for crimping onto an ignition wire, barrel tabs extending outwardly from the body portion near a second end and curved towards each other to define a terminal barrel for receiving a portion of the terminal post and wherein the barrel tabs are permanently fixed together at locations along edges of the tabs and wherein apertures are formed in the tabs defining the terminal barrel, and further comprising a snap ring formed from a variable width blank and having a raised feature formed near each of two opposite ends and wherein the snap ring is received over the terminal barrel so that each raised feature extends through an associated aperture in a and so that an interference fit is provided between each raised feature and the spark plug terminal post at the location of the annular groove, and wherein the snap ring has a tapered portion adjacent the raised features which has less material traversing the width of the snap ring than the amount of material traversing the width of the snap ring at a middle portion.

2. The ignition terminal system as set forth in claim 1 wherein the barrel tabs are permanently fixed together by a weld.

3. The ignition terminal system as set forth in claim 1 wherein the snap ring has an aperture formed therein adjacent each raised feature so that the amount of material traversing the width of the snap ring at the portion having the aperture is less than the amount of material traversing the width of the snap ring at a middle portion.

4. An ignition terminal system as set forth in claim 1 wherein the snap ring has outer edges that are indented at the tapered portion.

5. The ignition terminal system as set forth in claim 1 forming from a single-piece of continuous material.

6. The ignition terminal system as set forth in claim 2 wherein said weld is formed using a laser welding machine.

7. An ignition terminal system for use on a spark plug having a terminal post with an annular groove formed therein comprising, an ignition terminal having a body portion and crimp wings extending outwardly from the body portion near one end for crimping onto an ignition wire, barrel tabs extending outwardly from the body portion near a second end and curved towards each other to define a terminal barrel, an aperture formed in each of the terminal barrel tabs, a snap ring formed from a blank having outer edges forming a rectangle and having a raised feature formed near each of two opposite ends, a hole formed through the snap ring adjacent each raised feature, and wherein the snap ring is received over the terminal barrel so that each raised feature extend through an associated aperture in a tab and so that an interference fit is provided between each raised feature and a spark plug terminal post at the location of the annular groove, and wherein said tabs defining the terminal barrel are welded together.

8. An ignition terminal system for use on a spark plug having a terminal post with an annular groove formed therein comprising, a terminal having a body portion and crimp wings extending outwardly from the body portion for crimping onto an ignition wire, and barrel tabs extending outwardly from the body portion near a second end and curved towards each other to define a terminal barrel and wherein the barrel tabs are permanently fixed together at locations along edges of the tabs by a weld, and wherein apertures are formed in the tabs defining the terminal barrel, and further comprising a snap ring formed from a variable width blank and having a raised feature formed near each of two opposite ends and wherein the snap ring is received over the terminal barrel so that each raised feature extends through an associate aperture in a tab and so that an interference fit is provided between each raised feature and a spark plug terminal post at the location of the annular groove, and wherein the snap ring has a tapered portion adjacent the raised features that has less material traversing the width of snap ring than the amount of material traversing the width of the snap ring at a middle portion.

9. A combination comprising an ignition terminal and a spark plug having a terminal post with a head portion and an annular groove formed immediately below the head portion, the ignition terminal having a body portion and crimp wings extending outwardly from the body portion near one end for crimping onto an ignition wire, and barrel tabs extend outwardly from the body portion near a second end and curved towards each other to define a terminal barrel and wherein the barrel tabs are permanently fixed together at locations along edges of the tabs by a weld, and wherein an aperture is formed in each of the tabs defining the terminal barrel, and further comprising a snap ring formed from a variable width blank and having a raised feature formed near each of two opposite ends and wherein the snap ring is received over the terminal barrel so that each raised feature extends through an associated aperture in a tab and so that an interference fit is provided between each raised feature and the spark plug terminal post at the location of the annular groove and wherein the snap ring has a tapered portion adjacent each of the raised features and wherein there is less material traversing the width of the snap ring at the tapered portion than the amount of material traversing the width of the snap ring at a middle portion.

10. A combination comprising an ignition terminal and a spark plug having a terminal post with a head portion and an annular groove formed immediately below the head portion, the ignition terminal having a body portion and crimp wings extending outwardly from the body portion near one end for crimping onto an ignition wire, and barrel tabs extending outwardly from the body portion near a second end and curved towards each other to define a terminal barrel and wherein the barrel tabs are permanently fixed together at locations along edges of the tabs by a weld, and wherein an aperture is formed in each of the tabs defining the terminal barrel, and further comprising a snap ring formed from a variable width blank and having a raised feature formed near each of two opposite ends and wherein the snap ring is received over the terminal barrel so that each raised feature extends through an associated aperture in a tab and so that an interference fit is provided between each raised feature and the spark plug terminal post at the location of the annular groove and wherein the snap ring has an aperture formed therein adjacent each raised feature so that the amount of the material traversing the width of the snap ring the portion having the aperture is less than the amount of material traversing the width of snap ring at a middle portion.

11. An ignition terminal system for use on a spark plug having a terminal post with an annular groove formed therein comprising, a terminal having a body portion and crimp wings for crimping onto an ignition wire extending outwardly from the body portion near one end, tabs extending outwardly from the body portion near a second end and curved towards each other to define a terminal barrel, apertures being formed in the terminal barrel, a snap ring formed from a variable width blank and having a raised feature formed near each of two opposite ends and wherein the snap ring is received over the terminal barrel so that each raised feature extends through an associated aperture in the terminal barrel and so that an interference fit is provided between each raised feature and a spark plug terminal post at the location of the annular groove, and wherein the snap ring has portions adjacent the respective raised features that have less material traversing the width of the snap ring than the amount of material traversing the width of the snap ring at a middle portion.

12. The ignition terminal system as set forth in claim 11 wherein the portions adjacent the respective raised features have an aperture so that the amount of material traversing the width of the snap ring at the portions having the aperture are less than the amount of material traversing the width of the snap ring at the middle portion.

13. The ignition terminal system as set forth in claim 11 wherein the portions adjacent the respective raised features have outer edges that are indented so that the amount of material traversing the width of the snap ring at the portions having the aperture are less than the amount of material traversing the width of the snap ring at the tapered portion.

14. The ignition terminal system as set forth in claim 11 wherein the tabs are permanently fixed together at locations along edges of the tabs.

15. An ignition terminal system for use on a spark plug having a terminal post with an annular groove formed therein comprising, a terminal having a body portion and crimp wings for crimping onto an ignition wire extending outwardly from the body portion near one end, tabs extending outwardly from the body portion near a second end and curved towards each other to define a terminal barrel, apertures being formed in the terminal barrel, a snap ring formed from a blank having outer edges forming a rectangle and having a raised feature formed near each of two opposite ends, a hole formed through the snap ring adjacent each raised feature, and wherein the snap ring is received over the terminal barrel so that each raised feature extend through an associated aperture in the barrel and so that an interference fit is provided between each raised feature and a spark plug terminal post at the location of the annular groove.

* * * * *